US007261351B1

(12) United States Patent
Lee

(10) Patent No.: US 7,261,351 B1
(45) Date of Patent: Aug. 28, 2007

(54) SPREADER INCLUDING A DETECTION SYSTEM

(75) Inventor: Chin Thong Lee, Singapore (SG)

(73) Assignee: NSL Engineering Pte Ltd, Singapore (SG)

( * ) Notice: Subject to any disclaimer, the term of this patent is extended or adjusted under 35 U.S.C. 154(b) by 0 days.

(21) Appl. No.: 10/258,398

(22) PCT Filed: Apr. 24, 2000

(86) PCT No.: PCT/SG00/00053

§ 371 (c)(1),
(2), (4) Date: Mar. 26, 2003

(87) PCT Pub. No.: WO01/81232

PCT Pub. Date: Nov. 1, 2001

(51) Int. Cl.
*B66C 1/00* (2006.01)
*B66C 13/46* (2006.01)

(52) U.S. Cl. ..... 294/81.21; 294/81.1; 294/907

(58) Field of Classification Search ..... 294/81.2, 294/81.21, 81.3, 81.4, 81.5, 81.1, 907; 212/270, 212/274, 275
See application file for complete search history.

(56) References Cited

U.S. PATENT DOCUMENTS 3,598,440 A * 8/1971 Ramsden et al. ..... 294/81.3
3,887,080 A * 6/1975 Wilson ..... 212/318
4,172,685 A * 10/1979 Nabeshima et al. ..... 294/81.41
5,048,703 A * 9/1991 Tax et al. ..... 212/276
5,354,112 A * 10/1994 Hara et al. ..... 294/81.2
5,729,453 A * 3/1998 Lee et al. ..... 212/275
6,182,843 B1 * 2/2001 Tax et al. ..... 212/274
6,460,711 B1 * 10/2002 Kato et al. ..... 212/275
2005/0225104 A1 * 10/2005 Lim et al. ..... 294/81.1

FOREIGN PATENT DOCUMENTS

| | | | |
|---|---|---|---|
| DE | 4005066 | | 8/1991 |
| EP | 0595222 | | 5/1994 |
| EP | 0841296 | * | 5/1998 |
| JP | 10-194657 | | 7/1998 |
| WO | 92/19526 | | 11/1992 |
| WO | 94/05586 | | 3/1994 |

OTHER PUBLICATIONS

International Search Report.

* cited by examiner

*Primary Examiner*—Patrick Mackey
*Assistant Examiner*—Paul T. Chin
(74) *Attorney, Agent, or Firm*—Ostrolenk, Faber, Gerb & Soffen, LLP

(57) ABSTRACT

A spreader (1) for lifting a freight container (7, 17) comprises a frame (3, 4, 11) and two pairs of pickup elements (5). Each pair of pickup elements (5) are mounted at opposite ends of the frame (3, 4, 11) and the frame (3, 4, 11) is adjustable to adjust the separation of the two pairs of pickup elements (5). A detector (8) is movably mounted on the frame (3, 4, 11) for movement between a first position in which the detector (8) is closer to one pair of pickup elements (5) and a second position in which the detector (8) is closer to the other pair of pickup elements (5). The detector is adapted to detect a discontinuity in an object (7, 17) located below the spreader (1).

5 Claims, 2 Drawing Sheets

SPREADER INCLUDING A DETECTION SYSTEM

BACKGROUND OF THE INVENTION

The invention relates to a spreader for lifting a freight container.

Freight containers are normally moved using large metal frames known as spreaders which engage with the top of the container at the four corners to lift the container. Generally, spreaders which are capable of lifting a single container are adjustable so that they can pick up any size of container from 20 foot to 45 foot.

However, an operator, who will normally be located in a cabin up to 60 to 80 foot above the container to be lifted, may mistake two 20 foot containers which are located in end to end relationship for a single 40 foot container, especially if both the 20 foot containers are the same colour. If the operator then attempts to pick up the two 20 foot containers as a single 40 foot container, the twistlock elements of the spreader will be engaged with only two of the twistlock apertures of each container.

Therefore, when the operator lifts the spreader, as the adjacent ends of the two 20 foot containers are not supported, the containers will fall off the spreader damaging the spreader and also probably causing damage to any containers located below the containers being lifted and the contents of the containers. If the containers are fall over a ship, the failing containers can also cause structural damage to the ship. In addition, there is also a serious risk that any personnel in the vicinity of the containers will be injured by the falling containers or by other containers moved by the falling containers. As the total weight of a 20 foot container, including the contents, can be greater than 20 tons, this is a serious safety concern.

SUMMARY OF THE INVENTION

In accordance with a first aspect of the present invention, there is provided a spreader for lifting a freight container, the spreader comprising a frame, two pairs of pickup elements, each pair of pickup elements being mounted at opposite ends of the frame, and the frame being adjustable to adjust the separation of the two pairs of pickup elements, and a detector movably mounted on the frame for movement between a first position in which the detector is closer to one pair of pickup elements and a second position in which the detector is closer to the other pair of pickup elements, the detector being adapted to detect a discontinuity in an object located below the spreader.

In accordance with a second aspect of the present invention, a system for detecting a discontinuity in an object located below a spreader comprises a detector movably mounted on the spreader for movement parallel to or a processor coupled to the detector to receive output signals from the detector and an alarm device coupled to the processor, the processor activating the alarm device if the detector detects a discontinuity in an object below the spreader.

Typically, the detector may be an optical detector to detect a change in the wavelength or intensity of light reflected from an object located below the spreader. Alternatively, the detector may comprise a distance detector to detect changes in distance between the detector and an object located below the spreader, or any other suitable detector.

Preferably, a drive mechanism is also provided to move the detector between the first and second positions, and typically, the drive mechanism is a linear drive mechanism. Alternatively, the drive mechanism can be a rotary drive mechanism which, for example could cause the detector to move in a circle or other non-linear manner.

Typically, the system may also comprise a position sensor which provides information on the position of the detector to the processor as the detector moves between the first and the second positions. This has the advantage of enabling the processor to determine the position at which the detector detects a discontinuity. Therefore, if the detector detects two discontinuities, the processor can calculate the distance between the two discontinuities. If the object below the spreader is a container then the presence of two discontinuities will indicate that there are two containers located below the spreader and the processor can calculate the gap between the two containers. This is particularly useful if the spreader is a twinlift spreader with adjustable central pickup elements as this may permit the processor to control the position of the central pickup elements to correspond to the gap detected between the two containers located below the spreader.

Typically, the position sensor may be a rotary measuring device, such as an encoder. Alternatively, the position sensor may be a linear measuring device.

Typically, the detector may move in a line which is at an oblique angle to the longitudinal axis of the spreader. The longitudinal axis is a line that extends from one pair of pickup elements to the other pair and bisects a line between the pickup elements forming each pair. This has the advantage of reducing the separation between sampling points in the direction of the longitudinal axis, as the detector moves between the first and second positions.

BRIEF DESCRIPTION OF THE DRAWINGS

An example of a spreader in accordance with the invention will now be described with reference to the accompanying drawings, in which.

DETAILED DESCRIPTION OF THE INVENTION

Figure 1:
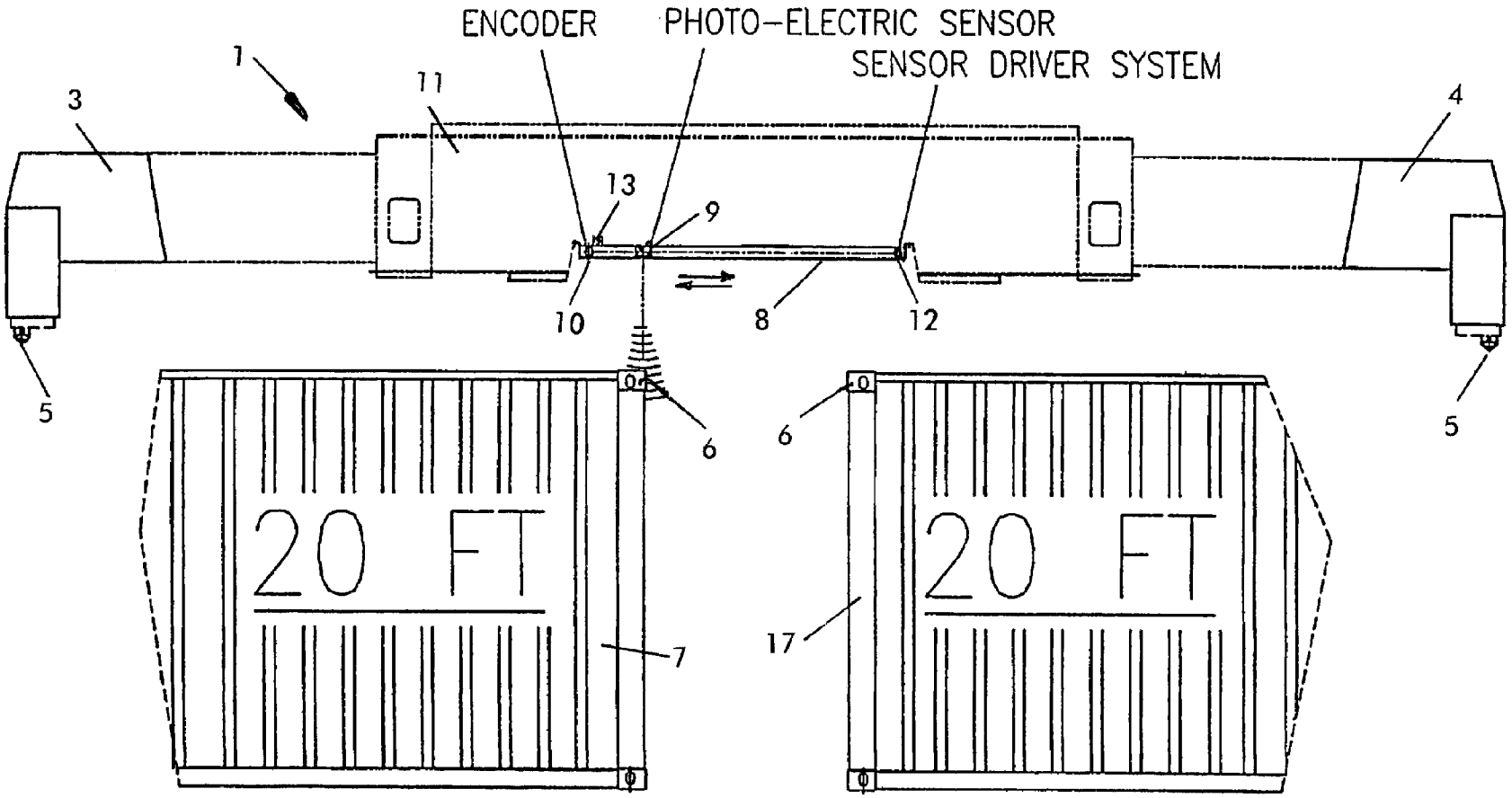
FIG. 1 is a side view of a spreader having a detection system and two 20 foot containers located below the spreader.

FIG. 1 shows a spreader 1 which has a central section 11 on which are mounted, at opposite ends, two telescoping arms 3, 4. Each telescoping arm 3, 4 has a pair of twistlock elements 5 located at the outer ends. The twistlock elements 5 are adapted to engage with a twistlock aperture in an upper corner section 6 of the containers 7, 17. Located on the underside of the central section 11 is a drive rail 8 on which is mounted a photo-electric sensor 9 which is movable along the drive rail 8 by a drive mechanism 9*a* (See FIG. 2) between a first end 10 and a second end 12. An encoder 13 is coupled to the drive mechanism 9*a* and produces an output which is indicative of the position of the sensor 9 on the drive rail 8. The output of the sensor 9 is indicative of the wavelength of light incident on the sensor 9. Both the sensor 9 and the encoder 13 have their outputs coupled to a processor (not shown) which processes the output signals from sensor 9 and encoder 13 and can use the signals to generate an alarm signal on an alarm device, which may be either an audible and/or visual alarm device, as will be explained below in more detail. Alternatively, or in addition, the spreader may automatically stop further movement of the spreader.

It is possible that the drive rail 8 may be positioned so that it is at an oblique angle to the longitudinal axis of the spreader 1. This has the advantage of increasing the resolution of the detection system by reducing the distance in the direction of the longitudinal axis between the sampling points of the sensor 9.

In use, the arms 3, 4 can be extended or retracted to pick up different sizes of containers from 20 foot to 45 foot. However, as an operator who is operating the spreader 1 to lift and move containers may be located 60 to 80 foot above a container to be lifted, if two 20 foot containers 7, 17 are located end-to-end and they are of the same or a similar colour, it is possible that the operator may mistake the two 20 foot containers 7, 17 for a single 40 foot container. If the operator lowers the spreader 1 to attempt to pick up the two containers 7, 17 in the mistaken belief that they are a single 40 foot container, the sensor 9 will move back and forwards between the end 10 and the end 12 along the drive rail 8 and sense the wavelength of light incident on the sensor 9. When the sensor 9 is above the container 7, the wavelength of light detected by the sensor 9 will be the wavelength of the light reflected from the top surface of the container 7 and will be substantially constant. However, when the sensor 9 moves to the position shown in FIG. 1, as the sensor moves further towards the right, the sensor 9 will stop detecting the wavelength of light reflected from the top surface of the container 7 and there will be a change in the output signal from the sensor 9. This is detected by the processor which then outputs an alarm signal to an alarm device which may be a visual and/or audible alarm device to warn an operator that a discontinuity has been detected in the object located below the spreader and that there is a risk that the object may not be a single 40 foot container but may be two 20 foot containers 7, 17. This enables the operator to check whether the two containers are a single 40 foot or two 20 foot containers 7, 17 and if necessary, alter the separation of the two pairs of twist lock elements 5 and the position of the spreader 1 to pick up one of the 20 foot containers 7, 17.

In addition, by having an encoder 13, the processor can determine the position of the sensor 9 when the discontinuity at the end of the container 7 is located and similarly can determine the position at which the discontinuity is detected by the sensor 9 when it reaches the edge of the container 17. This enables the processor to determine the separation of the two containers 7, 17. This is especially useful when the detector 9 is mounted on a twinlift spreader. If the twinlift spreader is a conventional twinlift spreader with fixed central pickup elements, the processor will be able to determine whether it is possible for the spreader to pick up both the containers simultaneously. Alternatively, if the twinlift spreader is of the type having adjustable central pickup elements, the processor can determine the gap between the containers 7, 17 and adjust the central pickup elements and the outer pickup elements so that the spacing between the central pickup elements is of the correct separation to permit both the 20 foot containers 7, 17 to be picked up simultaneously by the twinlift spreader.

Figure 2:
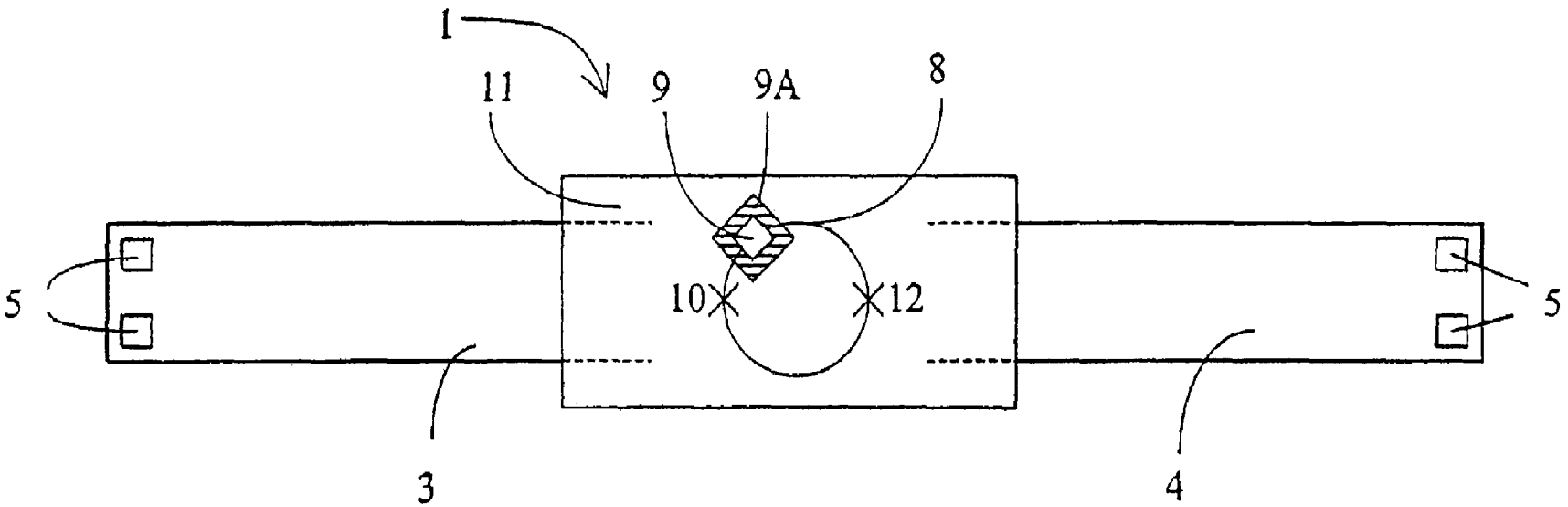
FIG. 2 is a top cross-sectional view of a spreader illustrating an embodiment where a detector is arranged to move in a circle.

FIG. 2 shows a top cross-sectional view of a spreader in an embodiment in which the sensor 9 is arranged to move along the spreader in a circular path. The reference numerals used are the same as those in FIG. 1. In FIG. 2, the sensor 9 is movable along the drive rail 8 by a drive mechanism 9*a*. The drive mechanism 9*a* can be a rotary drive mechanism which would cause the detector to move along the circular path between a first position 10 where it is closer to twist lock elements on the left hand side of the spreader and a second position 12 where the detector is closer to the twist lock elements 5 on the right hand side of the spreader.

For example, the detector 9 may be connected to or attached to the rotary mechanism 9A by bolting the detector's casing to the rotary mechanism 9A.

The drive system 9A may cause the detector 9 to move in a circle path by bolting the detector's casing onto a rotary bearing driven by an electric or hydraulic motor to move along the circular drive rail 8 (see FIG. 2).

For example, the photo-electric sensor 9 is moved along the drive rail 8 by a drive mechanism 9A in a manner similar to a wheel of a train moving along a rail track wherein the wheel of the train is driven by an electric motor.

The invention claimed is:

1. A spreader for lifting a freight container, the spreader comprising a frame, two pairs of pickup elements, each pair of pickup elements being mounted at longitudinally opposite ends of the frame, and the frame having a length that is adjustable to adjust the separation of the two pairs of pickup elements, a drive mechanism, a rail and a detector, the detector being mounted on the drive mechanism, and the drive mechanism movably mounted on the rail such that the detector is movably mounted indirectly on the frame for movement between a first position in which the detector is closer to one pair of pickup elements, while the length of the frame is unextended, and a second position in which the detector is closer to the other pair of pickup elements, while the length of the frame is unextended, the detector being movable between the first and second positions by the drive mechanism and adapted to detect a discontinuity in an object located below the spreader.

2. A spreader according to claim 1, wherein the detector comprises an optical detector to detect a change in wavelength or intensity of light reflected from an object located below the spreader.

3. A spreader according to claim 1, wherein the detector comprises a distance detector to detect changes in distance between the detector and an object located below the spreader.

4. A spreader according to claim 1, wherein the detector moves between the first and second positions in a line which is at an oblique angle to the longitudinal axis of the spreader.

5. A system according to claim 1, wherein the detector moves in a non-linear path between the first and second positions.

* * * * *